US006549106B2

(12) United States Patent
Martin

(10) Patent No.: US 6,549,106 B2
(45) Date of Patent: Apr. 15, 2003

(54) WAVEGUIDE WITH ADJUSTABLE BACKSHORT

(75) Inventor: John T. Martin, Portland, OR (US)

(73) Assignee: Cascade Microtech, Inc., Beaverton, OR (US)

( * ) Notice: Subject to any disclaimer, the term of this patent is extended or adjusted under 35 U.S.C. 154(b) by 0 days.

(21) Appl. No.: 09/948,208

(22) Filed: Sep. 6, 2001

(65) Prior Publication Data

US 2003/0043002 A1 Mar. 6, 2003

(51) Int. Cl.[7] ..... H01P 1/00
(52) U.S. Cl. ..... 333/248; 333/135; 333/137
(58) Field of Search ..... 333/248, 135, 333/137

(56) References Cited

U.S. PATENT DOCUMENTS 4,306,235 A * 12/1981 Christmann ..... 342/74
4,568,890 A * 2/1986 Bates ..... 331/96
4,835,495 A * 5/1989 Simonutti ..... 333/26
5,126,696 A * 6/1992 Grote et al. ..... 331/96
5,138,289 A * 8/1992 McGrath ..... 333/253
5,202,648 A * 4/1993 McCandless ..... 333/26
5,361,049 A * 11/1994 Rubin et al. ..... 333/26
5,611,008 A 3/1997 Yap
5,688,618 A 11/1997 Hulderman et al.
6,040,739 A * 3/2000 Wedeen et al. ..... 330/66

OTHER PUBLICATIONS

Arvind Kumar Sharma, *Tunable waveguide–to–microstrip transition for millimeter–wave application*; J–27, RCA Laboratories , David Sarnoff Research Center, Princeton, NJ; 1987 IEEE MTT–S Digest, pp. 353–356.

* cited by examiner

*Primary Examiner*—Michael Tokar
*Assistant Examiner*—Khai Nguyen
(74) *Attorney, Agent, or Firm*—Chernoff, Vilhauer, McClung & Stenzel, LLP

(57) ABSTRACT

A waveguide assembly including a waveguide, a backshort member, and an adjustment member, where the adjustment member is capable of receiving or input and transforming it into an output that causes the backshort member to be displaced in response to said input.

19 Claims, 4 Drawing Sheets

WAVEGUIDE WITH ADJUSTABLE BACKSHORT

BACKGROUND OF THE INVENTION

The present invention relates to a transition between a waveguide channel and a transmission line.

It Is well known in the prior art that electrical signals may be delivered through a variety of conductive media, such as solder traces, electrical wiring, coaxial or triaxial cables, waveguide channels, and microstrip lines, among numerous others. Usually, a given conductive medium will lend itself to a certain application, e.g. microcircuitry is better facilitated through the use of microstrip traces rather than triaxial cables.

Often, a particular electrical application will require that an electrical signal transition between two or more types of conductive media. High-frequency testing of a silicon wafer serves as an effective illustration of this point. Such testing typically involves the interconnection of manufactured testing equipment with an electrical probe, the combination measuring voltages and/or currents at preselected nodes in the device-under-test (DUT) in response to a specific test signal.

Wafer testing equipment is designed to be used repeatedly with a variety of test assemblies, and therefore includes input and output ports by which a particular probe system may be connected. Because coaxial adapters until recently have been unable to efficiently deliver signals above 65 GHz, frequently required for testing of today's high-speed semiconductor wafers, standard wafer testing equipment traditionally had been manufactured with ports that connect to waveguide channels, which are capable of delivering signals above 65 GHz.

Probes, however, usually deliver the test signal to the DUT through either slender needles or contacts formed on a membrane that overlays the DUT. In addition, most wafer probe assemblies require shielding of the test signal to reduce undesired electrical coupling that may interfere with the test measurements. Accordingly, it is not uncommon for a probe assembly to allow a test signal to first transition from a waveguide to a coaxial line, then to a trace line that terminates at either a needle or a contact depending on the type of probe employed.

Providing an efficient transition between a waveguide and a transmission line has proven problematic. For convenience, these types of transitions will be referred to as waveguide transitions. One widely used waveguide transition employs a waveguide channel into which the tip portion of a transmission line, such as the center pin of a coaxial cable, is inserted at a right angle to one of the interior surfaces of the waveguide. A backshort having a reflective face is also inserted into the waveguide. The backshort is typically made of brass and is oriented perpendicular to the waveguide channel so as to reflect the high-frequency signal towards the transmission line. The backshort is preferably located as close as possible to the transmission line. If properly positioned, the backshort will reflect the alternating signal within the waveguide into a standing wave pattern so that the signal will be induced in the transmission line with minimal degradation.

The waveguide transition just described has a number of limitations. Because a waveguide channel cannot effectively transmit a DC signal, such a transition would be unable to deliver a high frequency signal together with a DC offset, required for example, to hold transistors in an active state during testing. Further, tuning of the waveguide transition is often difficult. Minimum signal transfer occurs when the backshort is spaced apart from the transmission line an integral multiple of one-half signal-wavelengths, while maximum signal transfer occurs at odd multiples of one-quarter signal-wavelengths. Thus at high frequencies, very small deviations from an optimal backshort position may lead to significant losses in signal transfer.

An effective waveguide transition that may retain a DC offset is called a bias tee. Bias tees are used in a number of electrical configurations, including wafer probes. A bias tee typically includes a waveguide transition as previously described where the transmission line is a coaxial cable. A bias tee also includes a connection to a DC source that may provide a bias offset when desired. Any DC offset is combined with the alternating signal present within the waveguide channel by wiring the DC signal from the source to the center pin of the coaxial cable. Usually the DC signal is first passed through a choke so that any high-frequency signals induced in the coaxial cable by the waveguide are isolated from the DC source.

Solutions to the difficulty encountered in tuning the waveguide transition are more problematical. With bias tees, current practice is to adjust the position of the backshort by hand. Traditionally, a backshort is constructed with a necked-down portion having low tensile strength that can be used as a handle. Conductive epoxy is applied around the perimeter of the backshort, which is then inserted into the waveguide channel. Adjustment of the backshort position within the waveguide channel is accomplished manually. Once the desired location of the backshort is obtained, the epoxy is cured by placing the bias tee in a heater. The handle is broken off and removed from the backshort.

This accepted technique has a number of limitations. First, manual adjustment of the backshort does not permit effective fine-tuning, which becomes increasingly difficult at millimeter wavelengths where slight deviations in the backshort position can dramatically decrease performance. Second, if the backshort moves too far within the waveguide, bias circuit components can be damaged. Third, the backshort may shift during the curing process and the epoxy can seep into the waveguide channel which decreases performance. Fourth, once the backshort position is fixed, it is not suitable for a different test frequency range.

In applications other than bias tees, a number of waveguide transitions have been developed that employ adjustable backshorts. Grote et al., U.S. Pat. No. 5,126,696 for example, disclose a W-Band waveguide variable oscillator having a brass backshort equipped with a locking screw. When the locking screw is released, the backshort may be moved manually, thereby adjusting the power output of the oscillator. Similarly, Simonutti, U.S. Pat. No. 4,835,495, discloses a sliding backshort that relies upon friction between the backshort and the surrounding waveguide to maintain the backshort in position unless the friction is overcome by hand pressure. Though these configurations allow the transition to be re-tuned to suit a variety of frequencies, in each of these mechanisms tuning of the backshort occurs by hand, with all of the attendant shortfalls discussed earlier.

What is desired, therefore, is a waveguide transition having an adjustable backshort mechanism in which the backshort may be precisely positioned for maximum efficiency, without significant risk of overtravel and the attendant damage to circuit components. What is further desired is a waveguide transition with an adjustable backshort mechanism that, once adjusted, may be held in place without using conductive epoxy or a similar locking material within the waveguide channel.

DETAILED DESCRIPTION OF THE PREFERRED EMBODIMENT

Figure 1:
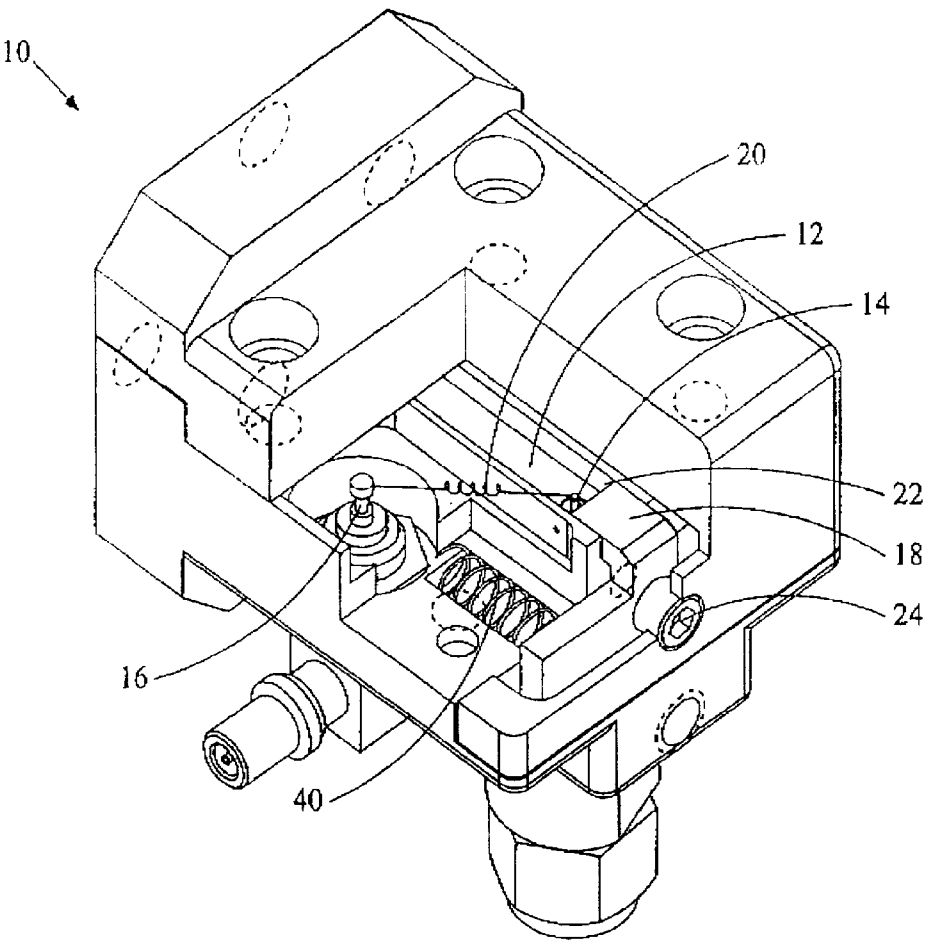
FIG. 1 shows an exemplary embodiment of a bias tee that includes an adjustable backshort, a body portion, and a cap portion.

Referring to the figures, wherein like numerals refer to like elements, FIG. 1 shows a bias tee 10 that is used to exemplify a preferred embodiment. It should be understood that other waveguide transitions exist apart from bias tees that may also benefit from the teachings herein. Some examples of alternate transitions are microstrip transitions, stripline transitions, and microwave antennas.

The bias tee 10 allows an alternating electrical signal to transition from a waveguide 12 to a transmission line 14, while also providing a DC offset voltage or current to be selectively added to the transmission line 14 from a connector 16. In the preferred embodiment, the transmission line 14 is a coaxial cable, though a variety of other transmission lines, such as a triaxial cable, a single bare wire, etc. may be substituted for the coaxial cable depicted in FIG. 1. Preferably, the transmission line terminates in a connector. Alternatively, the transmission line may be terminated in probe contacts. Similarly, a number of connectors will appropriately provide the DC offset, but for illustrative purposes, the preferred embodiment depicts a right angle SSMC connector.

As shown in FIG. 1, a portion of the coaxial cable 14, including the center pin, protrudes into the waveguide 12. A backshort member 18 with a reflecting face 22 is positioned at one end of the waveguide 12. The backshort member 18 reflects an alternating signal present within the waveguide towards the center pin, thereby inducing within the coaxial cable 14 an alternating electrical signal desirably having approximately the same amplitude and frequency as that present within the waveguide 12. A DC component may be selectively routed to the coaxial cable 14 from the connector 16, thereby providing a DC offset to the induced alternating signal. Optionally, a choke 20 may electrically interconnect the connector 16 and the coaxial cable 14 to prevent the induced alternating signal from being transmitted through the connector 16.

Existing backshorts are designed to move in direct response to an input, such as hand pressure. The present inventor considered these existing backshorts, and determined that dramatic performance improvements may be achieved by operationally interposing an adjustment member 24 between the backshort 18 and any applied input. The adjustment member 24 receives an applied input, transforms it into an output that then controls the movement of the backshort 18. Preferably, the output of the adjustment member 24 is less unwieldy than the input so that the reflecting face 22 may be moved to an appropriate position within the waveguide 12 with much more precision than that obtainable by previous design.

In the preferred embodiment, a screw is used as the adjustment member 24. As shown in FIG. 1, the screw 24 allows a rotational input applied at the screw head to be transformed into a transversal output applied on the backshort member 18. This controllable adjustment of the position of the backshort 18 represents a dramatic improvement over existing designs in that the backshort 18 is capable of precise adjustment to obtain optimal tuning. Existing backshort mechanisms contained within waveguide transitions are either non-adjustable, or if adjustable, rely upon mere hand pressure to slide the backshort member 18 along the waveguide channel 12. In the preferred embodiment, the adjustment member 24 allows the waveguide transition to be finely tuned, improving performance. Assuming, for example, that the adjustment member 24 is an 80 pitch screw and can be turned in 45 degree increments, a resolution of about 0.0016 inches may be achieved.

Further, the preferred embodiment obviates any need to place conductive epoxy within the waveguide channel. If, for example, a screw is used as an adjustment member 24, as described in the preferred embodiment, and it is desired that the backshort be permanently fixed in place, a thread-locking compound may be used on the screw 24. The thread locking compound is preferably applied outside of the waveguide channel, eliminating any potential for epoxy to bleed into the waveguide channel. Alternately, the backshort need not be permanently positioned, but instead may be retuned.

Because backshort movement within the waveguide channel may be positioned in much smaller increments in a controlled manner, there is a greatly reduced risk of damaging electrical components should the backshort be inadvertently pushed too far into the waveguide channel. The electrical components may include, for example, a crossover network and an out-of-band (waveguide band) signal termination for the bias tee. Again using a screw as an illustrative adjustment member 24, should the backshort member 18 be moved further into the waveguide 12 than optimally desired, the direction of backshort travel may simply be reversed by turning the screw in the opposite direction. Preferably, a sprint 40 assists in reversing the path of the backshort.

Though a screw is used to illustrate the manner in which the inclusion of an adjustment member 24 improves upon existing design, a variety of other devices or objects may be used as adjustment members. Examples might include a switch-activated electric positioner, a gear and pulley system operated by a handle, or a piezo-electric actuator. Similarly, the manner in which the input to the adjustment member is transformed may also vary. The adjustment member 24 may alter the nature of an applied input, the way the illustrative screw depicted in FIG. 1 converts a rotational input to a transversal output. Alternately, the adjustment member 24 may simply change the scale of an input, linearly or non-linearly, as would a gear and tooth assembly.

Figure 2:
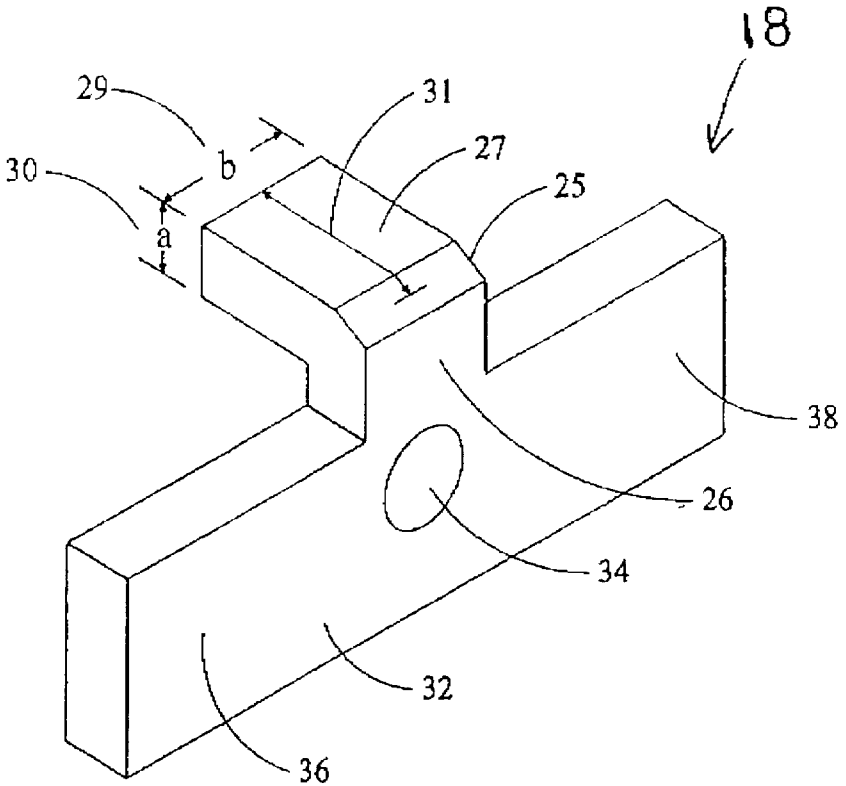
FIG. 2 shows the adjustable backshort of the bias tee of FIG. 1 at an enlarged scale.

Referring to FIG. 2, the backshort member 18 is preferably a unitary member, made from a casting or other process. In the preferred embodiment, the backshort member 18 includes a central elbow 25 having a supporting portion 26 and a cantilevered portion 27 oriented at substantially right angles to one another. The cantilevered portion 27 protrudes into the waveguide 12 and includes at its distal end a substantially planar reflecting face 22 oriented toward the coaxial cable 14.

The cantilevered portion 27 preferably has a width 29 and a depth 30 sized to fit securely within the waveguide 12 while retaining the ability to slide back and forth when the waveguide transition is being tuned. The cantilevered portion 27 has a length 31 measured from the supporting portion 26 preferably of sufficient length to permit the reflecting face 22 to closely approach the centerline of the coaxial cable 14. The preferred embodiment has proven able to bring the reflecting face 22 to within 0.25 inches of the coaxial cable 14, or closer. Other embodiments may have differing degrees of precision in this regard, though it should be noted that a waveguide transition performs better as these two elements are brought closer together. A stop (not shown) may be used to protect circuit components by limiting the movement of the backshort member 18 within the waveguide 12.

The backshort member 18 includes a base 32 from which the elbow 25 extends. The base 32 defines a hole 34 into which the screw 24 is engaged. The base 32 also includes two extensions 36 and 38 disposed laterally to either side of the hole 34. As shown in FIG. 1, a plurality of spring members 40 are located within the body of the bias tee 10 on either side of the waveguide 12 to apply an outwardly directed force to extensions 36 and 38, respectively. In the preferred embodiment, there are two such spring members 40. Turning the screw 24 in one direction moves the reflecting face 22 inwardly into the waveguide channel 12 , compressing the spring members 40. When compressed, the spring members 40 provide the requisite force to push the reflecting face 22 in an outwardly direction when the screw 24 is turned in the opposite direction.

Figure 3:
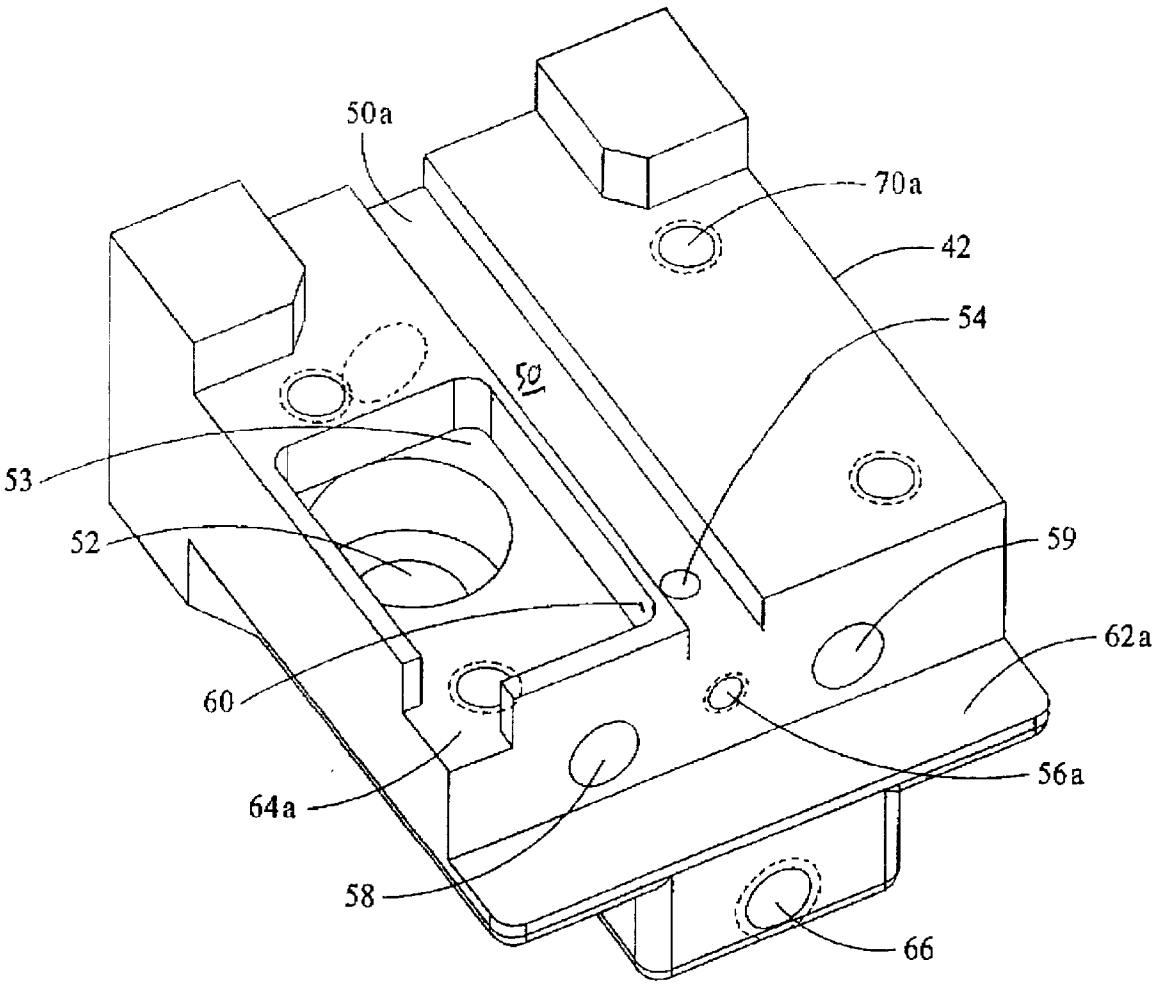
FIG. 3 shows the body portion of the bias tee of FIG. 1 at an enlarged scale.
Figure 4:
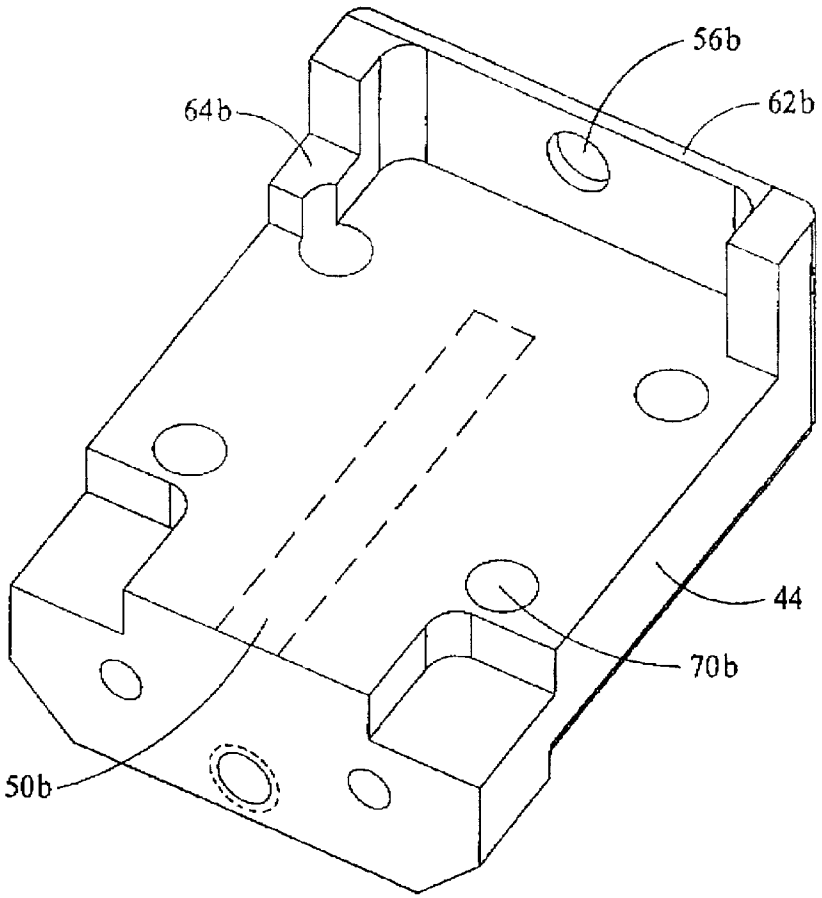
FIG. 4 shows the cap portion of the bias tee of FIG. 1 at an enlarged scale.

As shown in FIGS. 3 and 4, the bias tee 10 may be fashioned in two sections, namely, a bias tee body 42 and a bias tee cap 44. The bias tee body 42 and the bias tee cap 44 are designed to be engaged through a selective number of fastening cavities 70*a* and 70*b* contained in the bias tee body 42 and the bias tee cap 44, respectively.

Referring to FIGS. 3 and 4, the bias tee body 42 forms a lower waveguide surface 50A comprising three of the walls of the waveguide 12. The bias tee cap 44 forms a waveguide ceiling 50B that defines the fourth wall of the waveguide 12. The lower waveguide surface 50A and the waveguide ceiling 50B are preferably composed of a conductive material suitable for the transmission of electromagnetic waves at frequencies up to and above 65 GHz.

The bias tee body 42 also defines a coaxial cable port 54 within the lower wall of the lower waveguide channel surface 50. A connector port 52 contained within a connector cavity 53 facilitates the attachment of a connector 16 that may route a signal from a DC power supply (not shown) to the coaxial cable 14 fitted within the coaxial cable port 54. An opening 60 is defined by the side of the lower waveguide surface 50*a* to permit this connection. The connector cavity 53 preferably provides sufficient space so that, if desired, a choke 20 may be inserted between the connector 16 and the coaxial transmission line 14.

The bias tee body 42 includes a shelf portion 62A, and the bias tee cap 44 includes a lip portion 62B, both located at the side of the bias tee 10 with the backshort member 18. As can be seen in FIGS. 3 and 4, the shelf portion 62A of the bias tee body 42 and the lip portion 62B of the bias tee cap 44 are sized so that when the bias tee body 42 and the bias tee cap 44 are engaged, a space is provided within which the backshort member 18 may be fitted.

A threaded hole 56A is defined by the shelf portion 62A of the bias tee body 42 and an outer hole 56B is defined by the lip portion 62B of the bias tee cap 44. As can be seen in FIG. 1, when assembled, the screw 24 may be inserted into the outer hole 56B in the bias tee cap 44, through the backshort member 18 and into the threaded hole 56A in the bias tee body 42. In this fashion, the adjustable backshort 18 may be readily.tuned simply by turning the adjustment screw 24. Bias tee body 42 defines two cylindrical cavities 58 and 59, into which spring members 40 may be interested. Cylindrical cavities 58 and 59 are spaced symetrically about, and parallel to, the lower waveguide surface 58A.

It is to be understood that the adjustable backshort may likewise be used in other waveguide-to-transmission line structures apart from bias tees.

The terms and expressions employed in the foregoing specification are used therein as terms of description and not of limitation, and there is no intention in the use of such terms and expressions of excluding equivalents of the features shown and described or portions thereof, it being recognized that the scope of the invention is defined and limited only by the claims that follow.

What is claimed is:

1. A waveguide assembly comprising:

(a) a waveguide;

(b) a backshort member movably engaged with said waveguide so as to be relatively displaced with respect to said waveguide in response to an input;

(c) an adjustment member capable of receiving said input and transforming said input into an output that differs from said input; and (d) said output causing.said backshort member to be displaced relative to said waveguide in response to said input.

2. The waveguide assembly of claim 1 further comprising:

(a) said backshort member including a surface; and (b) said waveguide assembly including at least one resiliently flexible member in pressing engagement with said surface.

3. The waveguide assembly of claim 1 wherein said adjustment member is a screw.

4. The waveguide assembly of claim 1 wherein said backshort member includes a surface capable of reflecting an alternating signal traveling within said waveguide.

5. The waveguide assembly of claim 4 further comprising a transmission line operably electrically connected with said waveguide so as to sense said alternating signal.

6. The waveguide assembly of claim 5 wherein said transmission line may is capable of carrying said alternating signal toward a device under test.

7. The waveguide assembly of claim 6 further comprising a DC signal provided to said transmission line.

8. A bias tee comprising:

(a) a waveguide;

(b) a backshort member movably engaged with said waveguide so as to be relatively displaced with respect to said waveguide in response to an input;

(c) an adjustment member capable of receiving said input and transforming said input into an output that differs from said input;

(d) said output causing said backshort member to be displaced relative to said waveguide in response to said input;

(e) a transmission line operably electrically connected with said waveguide so as to sense said alternating signal; and (f) said transmission line is capable of receiving a DC signal.

9. The bias tee of claim 8 further comprising:

(a) said backshort member including a surface; and (b) said bias tee including at least one resiliently flexible member in pressing engagement with said surface.

10. The bias tee of claim 8 wherein said adjustment member is a screw.

11. The bias tee of claim 8 further comprising a DC signal provided to said transmission line.

12. The bias tee of claim 8 wherein said backshort member includes a surface capable of reflecting an alternating signal traveling within said waveguide.

13. The bias tee of claim 12 wherein said transmission line is capable of carrying said alternating signal toward a device under test.

14. A transition comprising:

(a) a waveguide;

(b) a backshort member movably engaged with said waveguide so as to be relatively displaced with respect to said waveguide in response to an input;

(c) an adjustment member capable of receiving said input and transforming said input into an output that differs from said input;

(d) said output causing said backshort member to be displaced relative to said waveguide in response to said input;

(e) a transmission line operably electrically connected with said waveguide so as to sense said alternating signal.

15. The transition of claim 14 further comprising:

(a) said backshort member including a surface; and (b) said transition including at least one resiliently flexible member in pressing engagement with said surface.

16. The transition of claim 14 wherein said adjustment member is a screw.

17. The transition of claim 14 further comprising a DC signal provided to said transmission line.

18. The transition of claim 14 wherein said backshort member includes a surface capable of reflecting an alternating signal traveling within said waveguide.

19. The transition of claim 18 wherein said transmission line is capable of carrying said alternating signal toward a device under test.

* * * * *

UNITED STATES PATENT AND TRADEMARK OFFICE

CERTIFICATE OF CORRECTION

PATENT NO. : 6,549,106 B2
DATED : April 15, 2003
INVENTOR(S) : John T. Martin

It is certified that error appears in the above-identified patent and that said Letters Patent is hereby corrected as shown below:

Column 4,
Lines 23-24, replace “thread locking” with -- thread-locking --.

Column 5,
Line 24, please delete the space between “12” and the “,”.

Column 6,
Line 3, please delete “.” and insert a space between the words “readily” and “tuned”.
Line 5, replace “interested” with -- inserted --.
Line 29, please delete “.” and insert a space between the words “causing” and “said”.

Signed and Sealed this

Fourth Day of November, 2003

JAMES E. ROGAN
*Director of the United States Patent and Trademark Office*